United States Patent [19]

Myers et al.

[11] Patent Number: 4,883,387

[45] Date of Patent: Nov. 28, 1989

[54] APPARATUS FOR TENSIONING A RISER

[75] Inventors: Roderick J. Myers; Jorge H. Delgado, both of Houston, Tex.

[73] Assignee: Conoco, Inc., Ponca City, Okla.

[21] Appl. No.: 212,801

[22] Filed: Jun. 29, 1988

Related U.S. Application Data

[63] Continuation-in-part of Ser. No. 41,904, Apr. 24, 1987, which is a continuation-in-part of Ser. No. 936,579, Dec. 1, 1986, Pat. No. 4,733,991.

[51] Int. Cl.[4] ..... E21B 43/01

[52] U.S. Cl. ..... 405/195; 166/367; 175/5

[58] Field of Search ..... 405/195, 202, 224; 175/5, 8, 9; 166/367, 359; 114/264, 265; 267/124, 125, 126, 128

[56] References Cited

U.S. PATENT DOCUMENTS

| | | | |
|---|---|---|---|
| 1,169,578 | 1/1916 | Stowasser | 267/168 |
| 1,873,807 | 8/1932 | Arnold | 267/128 |
| 2,778,506 | 1/1957 | Harry | 254/277 |
| 3,171,643 | 3/1965 | Roos | 267/124 |
| 3,508,409 | 4/1970 | Cargile, Jr. | 405/195 |
| 3,603,578 | 9/1971 | Herrera | 267/128 |
| 3,739,844 | 6/1973 | Peterman et al. | 166/.5 |
| 3,984,990 | 10/1976 | Jones | 405/195 |
| 4,004,532 | 1/1977 | Reynolds | 175/5 X |
| 4,058,301 | 11/1977 | Petrisko | 267/124 |
| 4,186,914 | 2/1980 | Radwill et al. | 267/168 |
| 4,198,179 | 4/1980 | Pease et al. | 405/195 |
| 4,215,950 | 8/1980 | Stevenson | 405/195 |
| 4,274,515 | 6/1981 | Bourcier de Carbon | 267/126 |
| 4,362,438 | 12/1982 | Spink | 405/195 |
| 4,379,657 | 4/1983 | Widiner et al. | 405/195 |
| 4,421,173 | 12/1983 | Beakley et al. | 175/5 X |
| 4,423,983 | 1/1984 | Dadiras et al. | 405/195 |
| 4,449,854 | 5/1984 | Nayler | 405/195 |
| 4,662,788 | 5/1987 | Kypke et al. | 405/204 |

*Primary Examiner*—David H. Corbin
*Attorney, Agent, or Firm*—Richard K. Thomson

[57] ABSTRACT

A tensioner system for a riser of a subsea production well. A plurality of at least three tensioners are each pivotally secured to both a lower surface of the production platform and to a tensioner ring that is itself secured to the riser. The tensioner ring may be generally octagonal with arms protruding from alternate faces of the octagon. These arms define the connecting points for the tensioners. The tensioners are angulated with respect to the axis of the riser, converging toward a single point lying on that axis and defining a first angle. The arms preferably form a second angle with respect to the body of the tensioner ring that is equal to said first angle so that the reaction surface defined by the bottom of the arms is perpendicular to the force lines along which the tensioners act. The failure of one of the tensioners will not result in unbalanced forces that could produce bending torsion, as occurred with previous designs. Further, each of the tensioners preferably provides a non-linear resisting force to relative movement between the platform deck and the riser. This enables the length of the tensioner rod to be significantly reduced which can have beneficial results on the profile of the platform and design requirements for the mooring system.

20 Claims, 5 Drawing Sheets

APPARATUS FOR TENSIONING A RISER

This application is a continuation-in-part of U.S. patent application Ser. No. 041,904 filed Apr. 24, 1987 which is a continuation-in-part of U.S. Ser. No. 936,579 filed Dec. 1, 1986 which issued Mar. 29, 1988 as U.S. Pat. No. 4,733,991.

BACKGROUND AND SUMMARY OF THE INVENTION

The present inVention relates to an apparatus for connecting a well on the ocean floor with a wellhead "Christmas" tree, (i.e., the flow control valves) on a fixed or relatively fixed platform, such as a floating tension leg platform or the like. More particularly, the present invention relates to an apparatus comprised of a riser tensioner system used in connecting the riser to the relatively fixed platform in order to avoid buckling of the riser. The tensioners of the present system apply a non-linearly responsive tension, the applied load increasing disproportionately at the back end in order to minimize the riser tensioner stroke length.

One of the benefits of a tension leg platform over other floating systems is the very small vertical oscillation that occurs. This enables the wellhead trees to be mounted within a few feet of a platform deck without the need for some complex form of motion compensation system. However, the use of a rigid riser system requires that a riser tensioner system be employed to compensate for the small amount of relative movement that does take place between the platform and the riser so that buckling or bending of the riser under its own weight will not result in a failure (cracking, breaking, etc.) of the riser. Heretofore, tensioner cylinders have typically provided a substantially linear load to the riser, i.e., that the tension load increases linearly in direct proportion to platform movement. Hence, the tensioner (both the cylinder and throw rod) must have a design length sufficient to accommodate the maximum platform movement possible (i.e., the movement caused by the design storm).

The present invention provides the desired motion compensation and tensioning of the riser by a plurality of tensioner cylinders which each have a non-linear response. That is, each tensioner provides a first rate of resistance (or tension) for normal platform movement and a second greater loading rate for storm-induced motion. This non-linear loading, in conjunction with the angulating of the riser tensioner cylinders such that they operate through a common point lying on the axis of the riser, enables the axial effective stroke length, and hence the distance between platform decks, to be significantly reduced. This can have an added benefit of reducing the profile of the floating platform and, hence, its wind loading, which reduces the forces that the tendons and risers will see and the size requirements for the already foreshortened riser tensioners.

Various other features, advantages and characteristics of the present invention will become apparent after a reading of the following specification.

DETAILED DESCRIPTION OF THE PREFERRED EMBODIMENT

Figure 1:
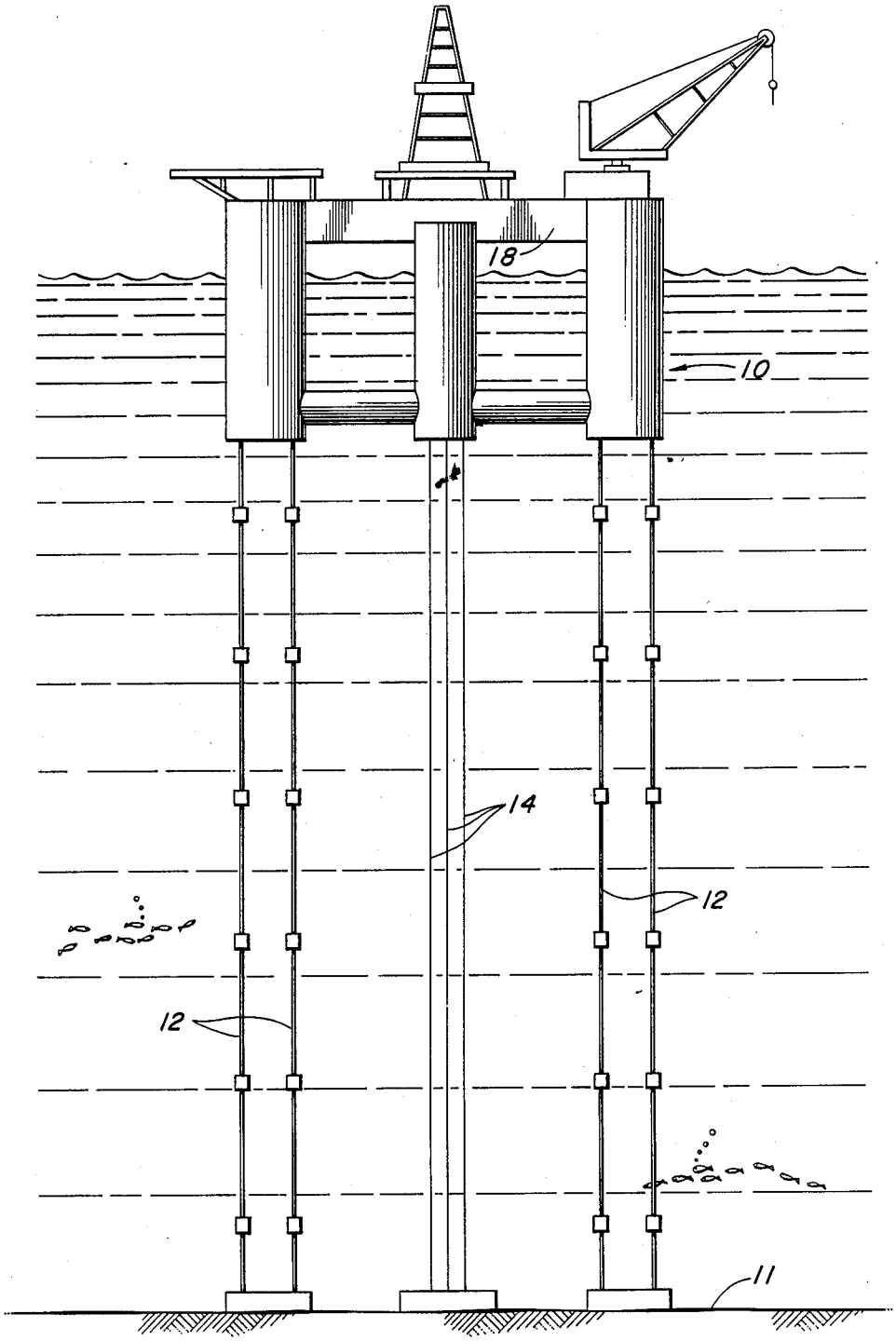
FIG. 1 is a schematic elevational view of a tension leg platform secured in position with production risers connected thereto.

A tension leg platform is shown in FIG. 1 generally at 10. While the riser tensioner of the present invention is peculiarly designed for use with a tension leg platform, it will be appreciated that such a tensioner might be utilized with other fixed and relatively fixed (i.e., floating systems with minimal vertical motion) platforms, as well.

Figure 2:
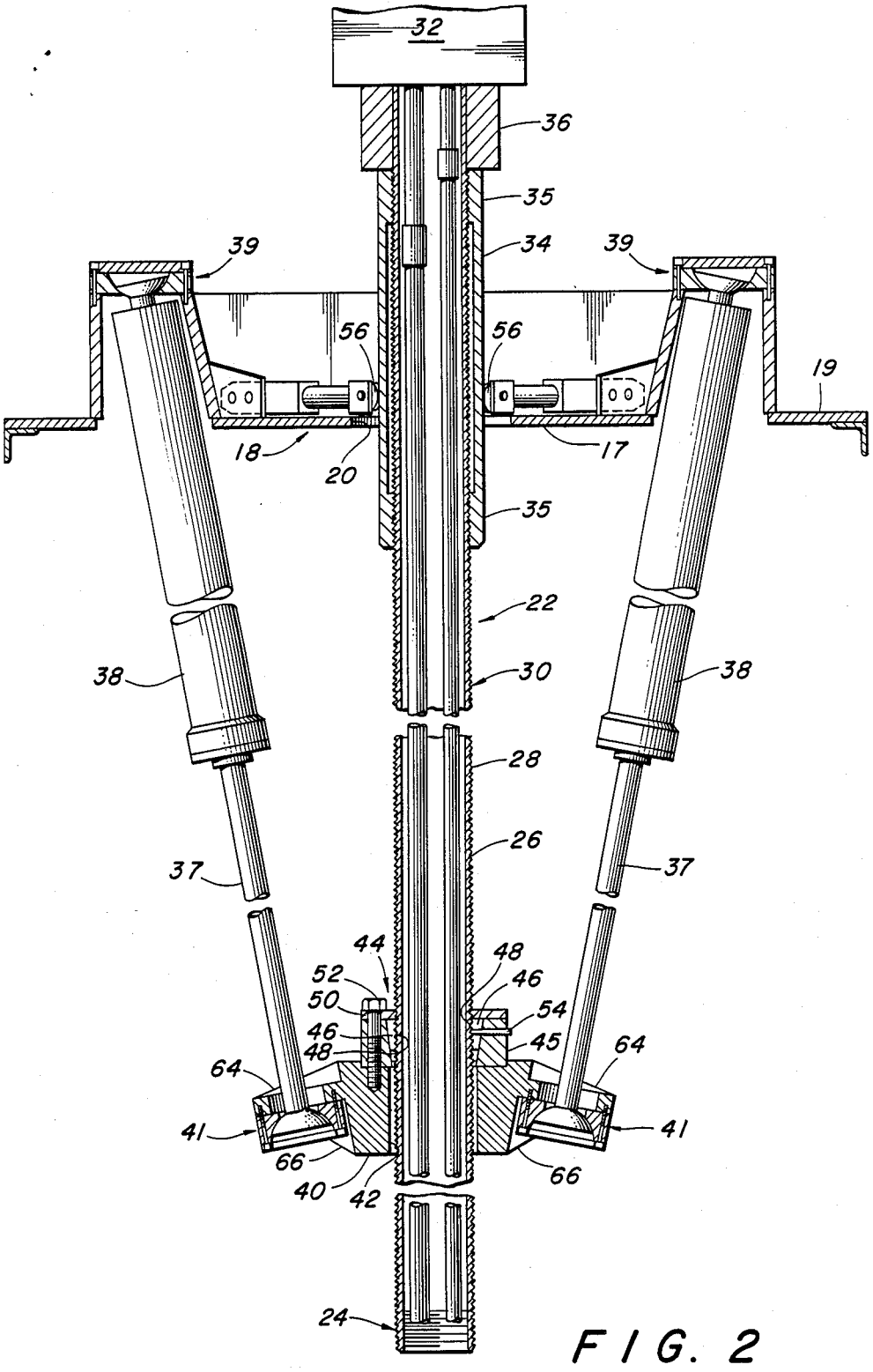
FIG. 2 is a schematic side view of the riser tensioner system of the present invention showing its usage connecting the riser to a tension leg platform.

Platform 10 is secured to the ocean floor 11 by a plurality of tendons 12. A plurality of risers 14 extend between the individual wells in template 16 and a wellhead deck 18 of platform 10. As seen in FIG. 2, riser 14 extends through a hole 20 in deck 18 that permits some relative motion between the deck and riser 14 that occurs as a result of environmental loads on the platform 10 and the riser 14.

One form of a riser top joint with which the present invention may be used is depicted in FIG. 2 generally at 22. Lower end 24 is internally threaded to connect with the standard riser joint in a conventional manner. Note, although a straight-walled thread is depicted, a tapered thread may be used if desired. The internal diameter of section 22 is to be the same as any other riser section in the particular string 14. The first outer diameter 26 will match that of the remainder of the riser. However, a second outer diameter is formed by a plurality of generally annular protrusions 28 that are generally equally spaced. In the top joint shown in FIG. 2, generally cylindrical protrusions 28 are formed by a continuous helical groove 30 formed on the outer surface of riser top joint 22.

Figure 3:
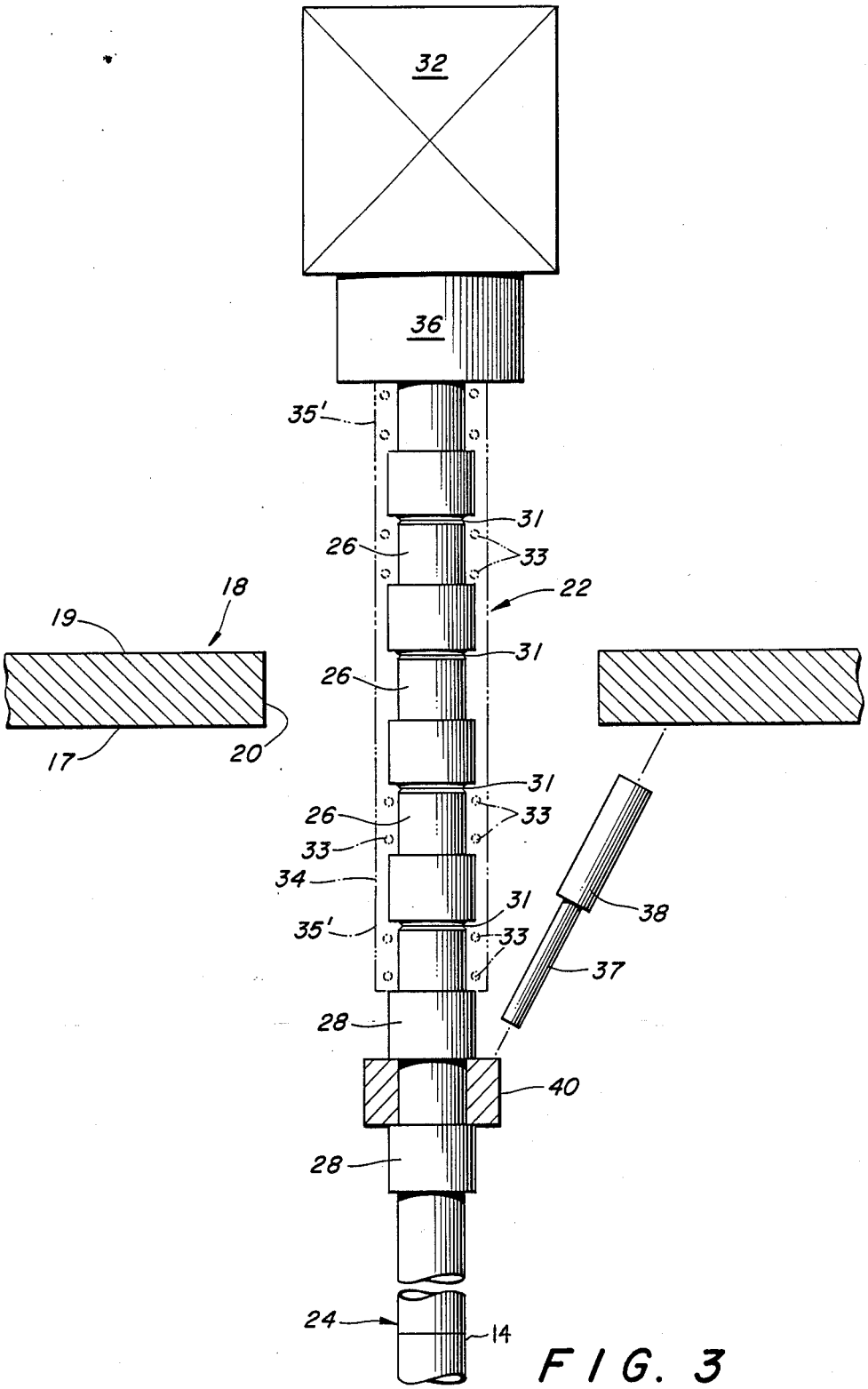
FIG. 3 is a schematic side view of a second type of the riser top joint with which the present invention may be used.

An alternate top joint configuration is depicted in FIG. 3. In this configuration, annular protrusions 28 are formed as cylindrical protrusions of a specified length and particular spacing rather than as a continuous helical groove. These design characteristics (length and spacing) will be selected in accordance with the particular needs of the application such as tensioner load parameters, accuracy of water depth measurement, etc. The surface of the riser may be scored as at 31 adjacent the bottom of each protrusion 28 for reasons to become apparent hereinafter.

In both the FIG. 2 and the FIG. 3 top joint configurations, top joint 22 extends through hole 20 in such a manner that a first plurality of annular protrusions 28 extend above the top surface 19 of deck 18 while a second plurality extend below the bottom surface 17 of the deck 18. The first plurality of protrusions 28 serve as a plurality of connecting points for well tree 32. Well tree 32 may be attached at any of the potential connection points by cutting off excess length of the riser guided initially by a thread groove or by the appropriate score line 31, installing either a unitary or a split segmented collar 34 at a position spaced from the top end of the riser top joint, attaching well tree 32 to the top end joint 22 and positioning packoff 36 upon collar 34. With respect to the utilization of the embodiment employing helical groove 30, the top 4 to 8 turns of the groove will be machined off after the riser joint has been cut to length so packoff 36 will have a smooth surface to engage.

The second plurality of protrusions 28 below the lower surface 17 of the deck 18 provide a series of connecting points for a second unitary or split collar tensioner ring 40 which in turn, is a connector for a series of riser tensioners 38. Riser tensioners 38 form critical components of the present invention and will be described in greater detail hereafter.

Figure 5:
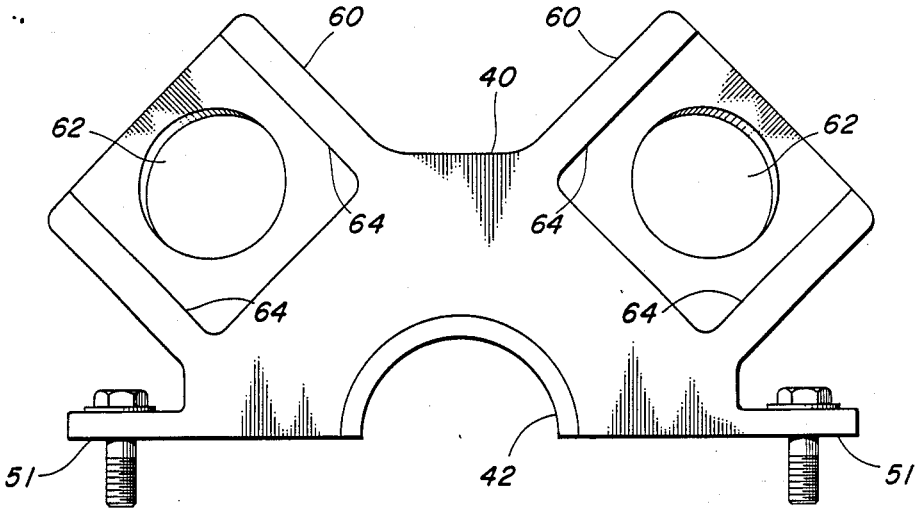
FIG. 5 is a top view of one segment of the split segmented riser tensioner ring used with the type riser top joint shown in FIG. 3.
Figure 4:
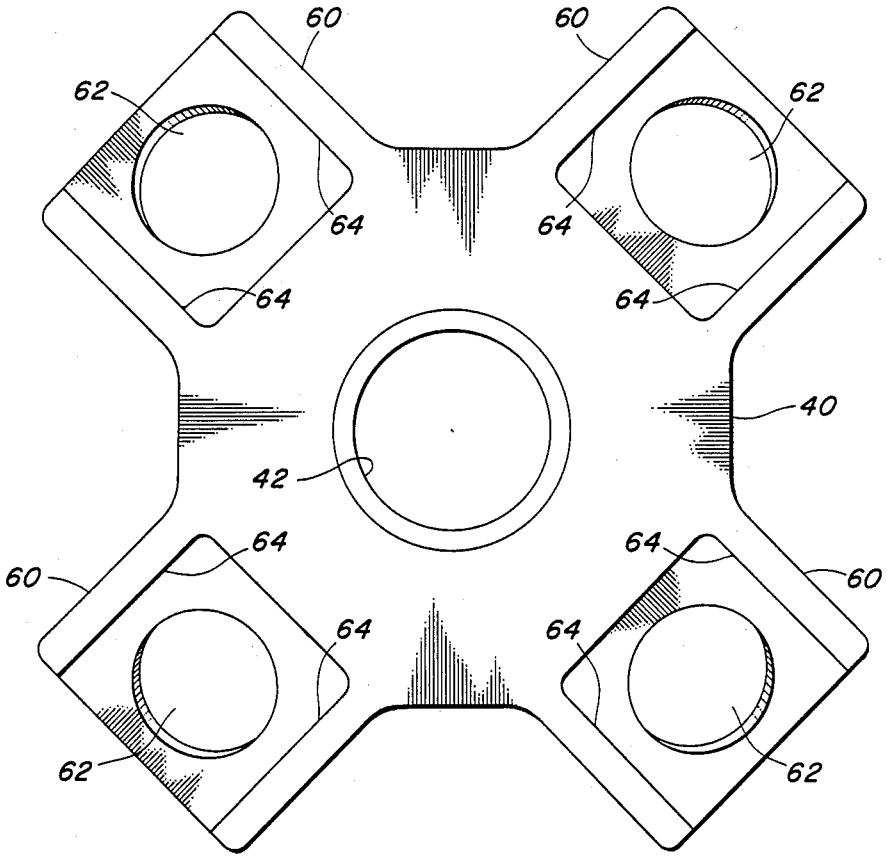
FIG. 4 is a top view of the unitary tensioner ring used in the FIG. 2 embodiment.

The unitary designed collar 40 shown in FIG. 4 is preferably used with the FIG. 2 embodiment while the split segmented collar design of FIG. 5 is more appropriate with the FIG. 3 configuration. The configuration of the riser tensioners 38, collar 40 and deck 20 of the FIG. 3 embodiment are substantially identical to the FIG. 2 device and, accordingly, have been shown schematically, depicting only the differences between the two embodiments.

The unitary design tensioner ring 40 shown in FIGS. 2 and 4 has a throughbore 42 of sufficient diameter to clear the outer diameter of spiral groove 30. As best seen in FIG. 4, ring tensioner 40 has a generally octagonal body with mounting arms 60 extending from alternate faces of the octagon. Each arm 60 has an opening 62 to receive the end of piston arm 37 and is provided with upper (64) and lower (66) reinforcing webs to strengthen ring 40. Each of these arms 60 is angulated somewhat with respect to the plane of the rest of the body (see FIG. 2) and preferably forms an angle equal to the average angle the riser tensioner 38 forms with centerline of riser 14. In this manner, the plane of each arm 60 will form a reaction surface that is generally perpendicular to a line of force acting along the centerline of the tension cylinder 38 and rod 37. While this angle will be a function of design (length of tensioners, diameter of ring, point of cylinder attachment, etc.), these angles will generally fall in the range of from about 10° to about 25°. Since each of the plurality of tensioners 38 acts through a common point, should one cylinder fail, there is no tendency to torque or bend the riser as was the case with previous configurations. Hence, there is no need to pair the operation of opposed cylinders. While any number of tensioners 38 can be used, it is preferred that a minimum of three be used (in which event, the body of the ring 40 would preferably be hexagonal) and, more preferably, a minimum of four.

A conventional slip mechanism 44 comprised of camming ring 45, wedges 46 with internally arcuate, threaded surfaces 48 and a clamping plate 50, is bolted to tensioner ring 40 by a plurality (one shown) of securing bolts 52. Camming ring 45 forces wedges 46 into engagement with spiral groove 30 and clamping plate 50 holds the wedges 46 in engaged position. A lateral pin 54 can be utilized to prevent relative rotation between camming ring 45 and wedges 46 and, hence, between tensioner ring 40 and top joint 22.

The split segment tensioner ring 40 of the FIG. 3 embodiment is shown in FIG. 5. The details of the configuration are similar with this alternate design being formed with two flanges 51 to permit the segments to be bolted together. As depicted schematically in FIG. 3, the inner diameter of opening 42 conforms generally to base diameter 26 to facilitate its connection to the stepwise variable riser top joint embodiment.

Lateral stabilizing rollers 56 engage the external surface of collar 34 and are spring biased to keep the riser 14 centered within opening 20. In the FIG. 2 embodiment only a short portion 35 at each end of collar 34 is full thickness (i.e., has a minimum internal diameter) and is threaded to engage the spiral groove 30 of top joint 22. In the FIG. 3 embodiment, sections 35' are full thickness to fill in the spaces between annular protrusions 28 and one section of split segment collar 34 is tapped as at 33 to receive connecting bolts (not shown) counter sunk in the other split segment. This provides a smooth external surface for stabilizing rollers 56 to engage and facilitates their operation.

The four riser tensioners 38 (two shown) are each interconnected to the platform deck 18 by a modified ball-and-socket joint 39 that permits some rotational movement between the tensioner 38 and deck 18 that will occur as the piston arm 37 of tensioner 38 extends and retracts to maintain a uniform tension on riser 14. A similar modified ball-and-socket connection 41 is used to connect the ends of piston arms 37 to tensioner ring 40 to permit the same rotational motion between tensioners 38 and tensioner ring 40. The top end of each riser tensioner is equipped with a pressure relief valve (not shown) to facilitate upward movement of piston 37 is tension cylinder 38.

By angulating the riser tensioners 38 to act through a common point, besides eliminating the requirement that opposite cylinders be paired, the additional benefit of shortening the vertical throw of the piston rod 37 is realized. It is the intention of this particular aspect of the invention to further reduce the throw of rod 37 by providing tension cylinder 38 with a non-linear load response, i.e., internal (or external) spring means 70 that produce a varying resistance to relative movement between deck 18 and riser 22.

Figure 6:
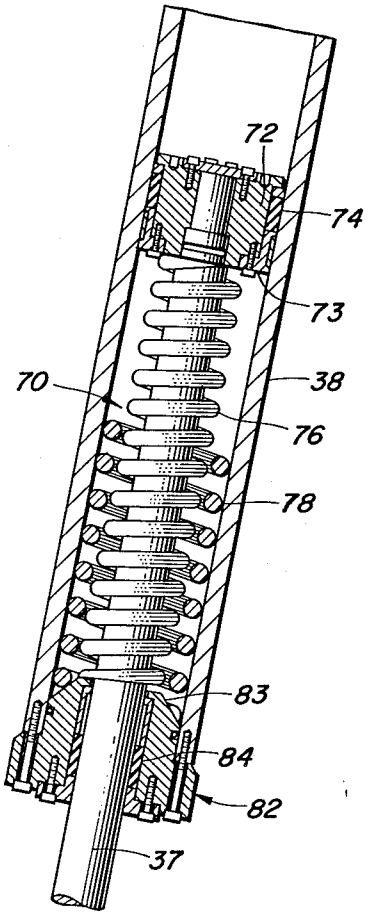
FIG. 6 is a lateral view in partial section of a first preferred embodiment of a non-linear tensioner used in the present invention.

A first preferred embodiment of spring means 70 is shown in FIG. 6. The upper end of piston rod 37 is fitted with piston head 72 which provides a first reaction surface 73. The lower end of tensioner cylinder 38 is closed by plug 82 which provides a second reaction surface 83. Piston head 72 is equipped with chevron seals 74 and plug 82 has chevron seals 84 which engage and seals against rod 37. It will be understood that for the sake of simplifying the Drawings, the internal details of the tensioner cylinder 38 is being detailed only once in FIG. 6. Accordingly, the chevron seals 74 and 84 are particularly applicable to the third embodiment which employs hydraulic fluid and may be optional for the embodiments employing mechanical springs. It is preferred that seals 84 be used to seal cylinder 38 against ingress from outside fluids such as salt water, rain, etc., even where use is designated optional.

In the FIG. 6 embodiment, spring means 70 takes the form of a first helical spring 76 and a second shorter and stiffer helical spring 78. The normal limited relative movement induced by most weather conditions will be handled by first spring 76. The more pronounced motion induced by heavy seas will be additionally resisted by second spring 78.

The combination of the interaction of springs 76 and 78 produce a non-linear response for the extension of rod 37. Indeed, since it is the extreme weather conditions that produce the upper limit for the length of tensioner cylinder 38 and rod 37, the non-linear response of the spring means 70 permits a significant savings in the length of these components. A conventional riser tensioner has a throw of 42". The total throw of rod 37 of the present riser tensioner is contemplated to be 20". Taken with a corresponding reduction in length of cylinder 38 and a further reduction in vertical length resulting from angulating the cylinders 38, a significant savings in deck spacing of the platform 10 can be realized which translates into a reduction in the height (or profile) of the platform. In this example, overall deck spacing can be reduced from 7 feet (2×42") to less than three feet (40" at a 25° angle). With a lower profile, the platform offers less wind reaction surface area and produces lower wind loading. This reduces the forces with which the mooring system has to cope and may also provide some weight savings (although this savings will be partially offset by the requirement to reinforce the deck to accommodate the additional loads it will experience).

Figure 7:
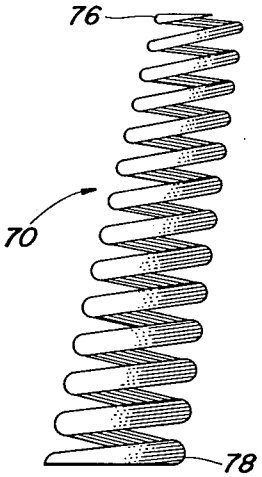
FIG. 7 is a side view of a single spring member having a dual spring rate which may be used in a second preferred embodiment of the present invention.

FIG. 7 shows a second preferred embodiment wherein spring means 70 is formed as a single spring with a continuously varying spring rate from a first end 76 with a first wire diameter and helical diameter to a second end 78 having a second wire diameter and helical diameter. Spring means 70 of this embodiment will perform substantially similarly to that of the first preferred embodiment, only the spring rate resistance will steadily increase (at generally a parabolic rate). Obviously, spring means 70 could be formed from a constant wire diameter with fixed helical diameter and two separate fixed coil spacings to produce a hybrid spring rate more closely akin to that of the FIG. 6 embodiment (substantially linear at first and then increasing parabolically).

Figure 8:
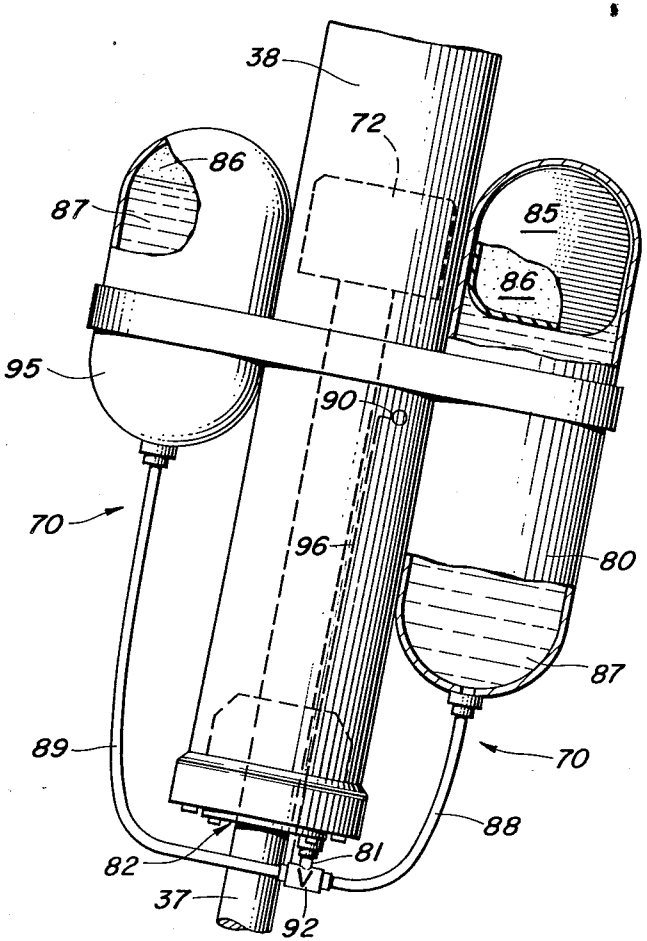
FIG. 8 is a lateral view in partial section of yet a third preferred embodiment of a non-linear tensioner used in conjunction with the present invention.

FIG. 8 depicts yet a third preferred embodiment in which a pair of hydraulic fluid collectors 80 and 95 are strapped to the outside of tensioner cylinder 38. Collectors 80 and 95 are connected through plug 82 by means of high pressure hoses 88 and 89 which connect through butterfly valve 92 with line 81. An optional flexible bladder 85, which takes the shape of the cylinder 38 which surrounds it, may confine a first amount of compressible fluid 86 (preferably nitrogen, or the like) above the hydraulic fluid 87. Bladder 85 prevents the compressible fluid 86 from becoming suspended in the hydraulic fluid 87 and escaping into cylinder 38.

Initially, valve 92 will be positioned such that cylinder 38 is connected with collector 80 through lines 81 and 88. This will provide an initial soft response due to the lower spring rate of collector 80 as compared to collector 94 because of its larger amount of compressible fluid 86. When piston head 72 moves along side proximity sensor 90, a signal is relayed through line 96 which flips valve 92 to interconnect collector 95 to cylinder 38. Proximity sensor 90 may be any conventional sensor or switch designed for such purpose but is more preferably of the magnetic type so that it may function non-intrusively (i.e., without piercing the body of cylinder 38). Note, it is preferred that fluid collectors 80 and 95 have the same diameter and hence, the same fluid surface area and that collector 95 be half as long as collector 80 with from between ½ to ¼ as much volume of compressible fluid 86. Accordingly, the resistance force of collector 95 will increase at a rate between 2 and 4 times that of collector 80. It is also preferred that the compressible fluid 86 in collector 95 be at approximately the same pressure as fluid 86 in collector 80 at the time of the changeover. Again, the overall spring response is generally parabolic in configuration, providing a significant increase in resistance to relative movement between the deck 18 and riser 2 as the amount of movement increases.

Figure 9:
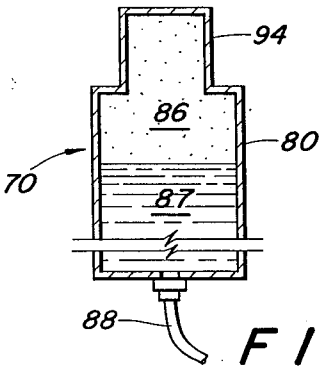
FIG. 9 is a lateral cross-sectional view of a collector useful in a fourth embodiment of the present invention.

Another embodiment, a variation of the hydraulic fluid collector embodiment of FIG. 8, is depicted in FIG. 9. Instead of a second collector for hydraulic fluid 87, fluid collector 80 is provided with an upper portion 94 that has a reduced diameter. Compressible fluid 86 generally fills this upper portion 94 as well as the upper reaches of the larger diameter bottom region of collector 80. As hydraulic fluid 87 fills collector 80 as a result of downward movement of piston head 72, it will meet with a first resistance force corresponding to compression of fluid 86 in the bottom region of collector 80 and, then, as fluid 86 moves into the upper portion 94, a second larger resistance force producing the same generally parabolic response curve as the other embodiments. While the smaller upper portion 94 will be specifically designed to provide the desired operational characteristics, it is preferred that its diameter fall in the range of from ½ to ¾ the diameter of the lower portion of collector 80. This will make the area between ¼ and 9/16 that of the lower portion (a function of the radius squared) resulting in a resistance force rate increase of between about 2 and 4 times that of the lower portion.

The riser tensioner system of the present invention provides a greatly simplified means of tensioning a production riser 14 without subjecting it to unbalanced forces that could lead to bending or breaking of the riser or production tubing contained within. The tensioner ring provides a plurality (three or more) of connecting points in arms 60 that is equal to the number of tensioner cylinders 38 to be used. The arms 60 preferably are each angled with respect to the plane of the body portion of the ring 40 with the specified angle being equal to the angle formed between the tensioner and the riser so the reaction surfaces formed thereby will be generally perpendicular to the action lines of force for tensioners 38. In the event of failure of one of the system's tensioners, the system will continue to operate effectively and no extraordinary effort need be made to replace the inoperative tensioner. Rather, the defective part may be replaced when it becomes convenient (e.g., after a storm has passed). Further, by providing a spring means 70 with a non-linear response, the throw of piston rod 37 can be significantly reduced which reduces the length of cylinder 38, the required distance between decks, the profile of the platform and, in turn, the design requirements for the mooring system.

Various changes, alternatives and modifications will become apparent following a reading of the foregoing specification. Accordingly, it is intended that all such changes, alternatives and modifications as come within the scope of the appended claims be considered part of the present invention.

We claim:

1. Apparatus for resiliently interconnecting a substantially rigid riser with a deck of a floating production platform, said apparatus comprising a plurality of riser tensioner cylinders each including a piston rod with a piston head connected thereto, said piston rod having a first length, and said riser tensioner cylinder having a second length, means for mounting said piston rod for movement within said riser tensioner cylinder;

means connecting each of said piston rods to said riser at an angle relative thereto;

spring means engaged between each said piston head and each said riser tensioner cylinder adapted to apply an upward tensioning force on said riser, wherein said spring means exert a non-linearly increasing force between said deck and said riser as relative motion between said deck and said riser increases, such that said first length of said piston and said second length of said cylinder may be significantly reduced thereby reducing the overall vertical distance between said platform deck and said means interconnecting said riser and said piston rod.

2. The apparatus of claim 1 wherein said spring means comprises a first spring means having a first spring rate and a second separate spring means having a second spring rate greater than said first spring rate.

3. The apparatus of claim 2 wherein said first and second spring means comprise coaxial helical springs.

4. The apparatus of claim 2 wherein said first and second spring means comprise a first and second collector each containing a first compressible fluid and a second incompressible fluid.

5. The apparatus of claim 4 wherein said compressible fluid comprises nitrogen.

6. The apparatus of claim 4 wherein the compressible fluid is confined within a flexible bladder.

7. The apparatus of claim 4 wherein said first and second collectors are connected to said riser tensioner cylinder through a common valve means.

8. The apparatus of claim 7 wherein said second collector has approximately the same diameter as said first collector but only one half its length.

9. The apparatus of claim 8 wherein said compressible fluid in said second collector is a volume of $\frac{1}{2}$ or less than a volume of compressible fluid in said first collector at equal pressure.

10. The apparatus of claim 9 wherein said volume of compressible fluid in said second collector is in a range from about $\frac{1}{2}$ to $\frac{1}{4}$ the volume in said first collector.

11. The apparatus of claim 1 wherein said spring means comprises a single helical spring wound in such a manner to produce a non-linearly varying spring rate.

12. The apparatus of claim 11 wherein said spring means is wound in such a manner as to produce a substantially parabolic rate of variance in said spring rate.

13. The apparatus of claim 1 wherein said riser tensioner cylinders each comprise a hydraulic cylinder.

14. The apparatus of claim 13 wherein each hydraulic cylinder further comprises collector means for excess hydraulic fluids.

15. The apparatus of claim 14 wherein collector means comprises a pair of collectors including a first collector and a second collector smaller than the first, for receiving excess hydraulic fluid.

16. The apparatus of claim 15 wherein each pair of collectors includes a first amount of compressible fluid in said first collector trapped above its hydraulic fluid and a second lesser amount of compressible fluid in said second collector trapped above its hydraulic fluid.

17. The apparatus of claim 15 wherein said first and second collectors are connected to their respective riser tensioner cylinder through a valve means which permits said first and second collectors to be successively connected to said riser tensioner cylinder to provide a varying spring rate resistance to movement of said piston head.

18. The apparatus of claim 16 wherein said compressible fluid is confined within an elastomeric bladder.

19. The apparatus of claim 14 wherein said collector means comprises a collector vessel having a bottom portion with a first diameter and an upper portion having a second smaller diameter for receiving and pressurizing an amount of compressible fluid.

20. The apparatus of claim 19 wherein said second smaller diameter is in the range of from $\frac{1}{2}$ to $\frac{3}{4}$ of said first diameter.

* * * * *